US005349892A

United States Patent [19]

Taylor et al.

[11] Patent Number: 5,349,892

[45] Date of Patent: Sep. 27, 1994

[54] PROPELLANT STICK KERFING APPARATUS AND METHOD

[75] Inventors: Michael A. Taylor, Circle Pines; Steven R. Chambers, Zimmerman, both of Minn.

[73] Assignee: Alliant Techsystems Inc., Hopkins, Minn.

[21] Appl. No.: 788,408

[22] Filed: Nov. 6, 1991

[51] Int. Cl.[5] ..... F42B 3/20; D03D 23/00

[52] U.S. Cl. ..... 86/21; 86/20.1; 147/107.6; 102/332

[58] Field of Search ..... 102/332; 86/20.1, 21; 149/109.6

[56] References Cited

U.S. PATENT DOCUMENTS

| | | | |
|---|---|---|---|
| 660,568 | 10/1900 | Gathmann | 86/20.1 |
| 3,647,200 | 3/1972 | Gross | 102/313 |
| 4,420,440 | 12/1983 | Marz | 86/20.1 |
| 4,705,655 | 11/1987 | Maures et al. | 86/20.1 X |
| 4,898,066 | 2/1990 | Marz | 86/20.1 X |
| 4,963,296 | 10/1990 | Niedermeier et al. | 86/20.1 X |

*Primary Examiner*—Peter A. Nelson
*Attorney, Agent, or Firm*—Vidas, Arrett & Steinkraus

[57] ABSTRACT

A propellant stick kerfing apparatus includes a support frame, a conveyor mounted on the support frame and operable for conveying a succession of spaced propellant sticks along a path of travel with the sticks extending in transverse relation to the direction of travel, a drive arrangement mounted on the support frame and coupled to the conveyor for driving the conveyor to advance the succession of propellant sticks along the path of travel, and pairs of upper and lower blades mounted stationarily on the support frame and defining cutting edges for making transaxial kerfs in the propellant sticks from opposite upper and lower sides thereof as the succession of spaced sticks are advanced along the path of travel between the cutting edges. The upper and lower blades define the upper and lower cutting edges in an oppositely inclined orientation in which the upper and lower cutting edges converge forwardly toward one another, intersect the path of travel of the succession of sticks, and engage the sticks for making pairs of transaxial kerfs in the sticks as the succession of sticks are advanced along the path of travel between the cutting edges. Each pair of upper and lower blades is spaced from adjacent pairs in a direction transverse to the direction of travel and staggered in the direction of travel relative to adjacent pairs of blades.

20 Claims, 4 Drawing Sheets

PROPELLANT STICK KERFING APPARATUS AND METHOD

The Government has rights in this invention pursuant to contract No. DAAA21-89-C-0093, awarded by the Department of the Army.

BACKGROUND OF THE INVENTION

1. Field of the Invention

The present invention generally relates to kerfing propellant sticks and, more particularly, is concerned with an apparatus and method for making spaced pairs of transaxial kerfs in propellant sticks without increasing stick length or reducing stick density.

2. Description of the Prior Art

Making transaxial kerfs, or cuts, in lengths of propellant stick containing multiple axial perforations has been practiced for many years, as attested by U.S. Pat. No. 660,568 to Gathmann which issued Oct. 30, 1990. The term "transaxial" means the kerf is made transverse or generally perpendicular to the longitudinal axis of the propellant stick. The purpose for transaxially kerfing axially perforated propellant sticks is to create an escape route for products of combustion which otherwise become trapped in the perforations during deflagration of the propellant. Without the presence of the kerfs, pressures in the perforations will build up and likely cause fracturing of the stick, adversely affecting burn rates.

The Gathmann patent discloses transaxial kerfs made in the propellant stick from one side. More recently, transaxial kerfs arranged in axially spaced pairs emanating from opposite sides have been provided in perforated propellant sticks. The amount or pressure build-up in the perforations of the propellant stick is controlled by the amount of spacing between the pairs of transaxial kerfs. Further, the transaxial kerfs of each pair terminate at inner ends being located beyond the longitudinal axis of the stick such that the kerfs overlap one another at their inner ends. The overlap of the kerf inner ends provides assurance that all perforations have been transected and vented. Also, the transaxial kerfs of each pair are axially offset from one another, with the amount of axial spacing between the kerf pairs typically being greater than the amount of offset between individual kerfs of each pair. The amount of kerf offset is selected so as to ensure that the kerfed propellant sticks will retain a degree of relative strength or rigidity sufficient to withstand the required subsequent handling operations.

The propellant of the kerfed sticks is, in effect, granular propellant specifically arranged to allow for maximum pack density. Maximum pack density is highly desired when loading cartridge ammunition with a fixed chamber volume to maximize the loaded propellant charge weight. From increased propellant charge weights increased internal ballistic pressures are produced which, in turn, generate increased muzzle velocities. In a kinetic energy application, the impact energy is directly proportional to the square of the projectile velocity. The performance of advanced development penetrators depends greatly on the velocity with which they can be delivered to the target.

One conventional method for making transaxial kerfs in propellant sticks involves the use of a hydraulic or mechanical press to drive offset blades into a stationary stick of propellant from its opposite sides to prescribed depths to maintain overlap of adjacent kerfs. The spacing between transaxial kerf pairs is established either by indexing the propellant stick between each kerfing cycle of the press or by gang kerfing with several sets of blades at a time which are properly spaced.

However, both of these ways of forming axially spaced pairs of transaxial kerfs in the propellant stick have drawbacks. On the one hand, forming a single pair of transaxial kerfs at a time in the propellant stick and then indexing the propellant stick before making the next pair of kerfs yields an extremely low rate of production. On the other hand, in gang kerfing the propellant stick is typically displaced by the introduction of the blades into the propellant stick thereby creating forces which tend to deflect adjacent sets of blades. This latter effect, which increases as the number of blades in the gang are increased, generates a kerf which is not perpendicular to the longitudinal axis of the propellant stick. The angle of the kerf reduces the overlap such that the reliability of the perforations' venting may be compromised.

Furthermore, the conventional method produces a kerf in the form of a V-shaped deformation open at the surface and narrowing to an intersection at the full depth of the kerf. For the JA-2.19-perforation stick propellant used by the 120 mm tank ammunition program, the net result of this deformation is a two percent increase in the length of the stick of propellant after kerfing. This corresponds to a two percent decrease in propellant stick density, resulting in a two percent loss in loaded propellant charge weight and in projectile velocity.

Consequently, a need exists for improvement of the manner by which kerfing of propellant sticks is performed so that the above-described drawbacks associated with the conventional technique will be avoided.

SUMMARY OF THE INVENTION

The present invention provides a propellant stick kerfing apparatus and method designed to satisfy the aforementioned needs. The apparatus and method of the present invention, by improved orientation of the kerfing blades and by moving the propellant stick relative to the blades, can make spaced pairs of transaxial kerfs in propellant sticks without increasing the length of the propellant stick length or reducing the stick density. Compared to the above-mentioned conventional method, the method of the present invention avoids any decrease in the total propellant charge weight and thus, in effect, results in an increase in total propellant weight of two percent.

Accordingly, the present invention is directed to a propellant stick kerfing apparatus which comprises: (a) a support frame; (b) means mounted on the frame for conveying a succession of spaced propellant sticks along a path of travel with the propellant sticks extending in transverse relation to the direction of travel; (c) means mounted on the support frame and coupled to the conveying means for driving the conveying means to advance the succession of propellant sticks along the path of travel; and (d) means mounted on the support frame across the path of travel of the propellant sticks and defining stationary cutting edges for making transaxial kerfs in the propellant sticks from opposite upper and lower sides thereof as the succession of spaced sticks is advanced along the path of travel between the cutting edges.

The cutting edges-defining means is a plurality of upper and lower blades which define upper and lower cutting edges in an oppositely inclined orientation in which the upper and lower cutting edges converge forwardly toward one another, intersect the path of travel of the succession of sticks, and engage the sticks for making pairs of transaxial kerfs in the sticks as the succession of sticks is advanced along the path of travel between the cutting edges. The upper and lower blades are arranged in pairs being spaced from adjacent pairs in a direction transverse to the direction of travel and staggered in the direction of travel with respect to adjacent pairs.

The present invention also is directed to a propellant stick kerfing method which comprises the steps of: (a) conveying a succession of spaced propellant sticks along a path of travel with the propellant sticks extending in transverse relation to the direction of travel; (b) stationarily disposing a plurality of pairs of upper and lower blades across the path of travel of the succession of spaced propellant sticks with each pair of upper and lower blades being spaced from adjacent pairs of blades in a direction transverse to the direction of travel of the succession of propellant sticks; and (c) engaging oppositely inclined stationary cutting edges of the pairs of blades with the succession of propellant sticks and making transaxial kerfs in the propellant sticks from opposite upper and lower sides thereof as the succession of spaced sticks are advanced along the path of travel between the cutting edges of the pairs of blades.

The step of disposing the pairs of upper and lower blades relative to the path of travel of the propellant sticks also includes the additional steps of laterally offsetting the upper and lower blades of each pair from one another, vertically overlapping the upper and lower blades with one another, and staggering the pairs of blades in the direction of travel relative to adjacent pairs of blades.

These and other features and advantages of the present invention will become more apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
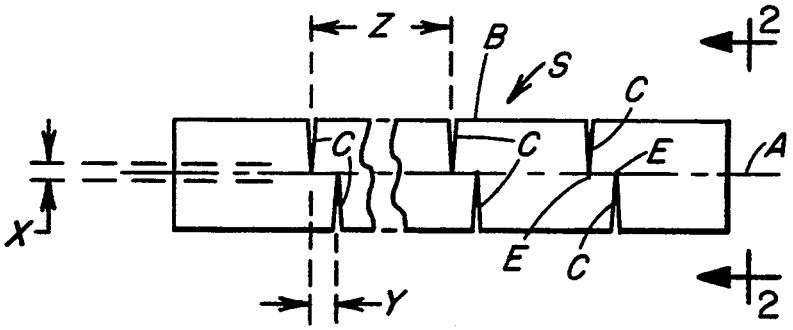
FIG. 1 is a side elevational foreshortened view of a propellant stick having spaced pairs of transaxial kerfs which are made by the kerfing apparatus and method of the present invention.
Figure 2:
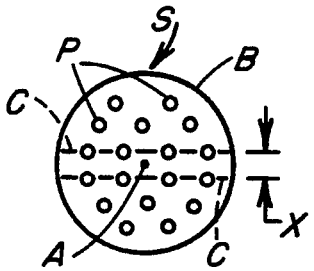
FIG. 2 is an enlarged end elevational view of the propellant stick as seen along line 2—2 of FIG. 1.

Referring now to the drawings, and particularly to FIGS. 1 and 2, there is illustrated an axially perforated propellant stick S which has been finished by a kerfing apparatus, generally designated 10, (FIGS. 3 and 4) of the present invention operating in accordance with the steps of a kerfing method of the present invention. The kerfed propellant stick S has an elongated rod-like body B containing a plurality of axially-extending perforations P and a plurality of pairs of kerfs or cuts C imparted transaxially along the body B by the kerfing apparatus and method of the present invention.

The critical dimensions of the kerfs C provided in the propellant stick S by the apparatus 10 and method of the present invention are the kerf overlap X, kerf offset Y, and kerf spacing Z. The transaxial kerfs C of each pair extend transversely or generally perpendicularly into the propellant stick S from opposite sides thereof and terminate at their inner ends E at positions located beyond the axis A of the stick S such that the transaxial kerfs C overlap with one another at their inner ends E by the amount X. Also, the transaxial kerfs C of each pair are axially offset from one another by the amount Y. The amount of spacing Z between the pairs of transaxial kerfs C is substantially greater than the amount of offset Y between individual transaxial kerfs C of each pair.

Figure 4:
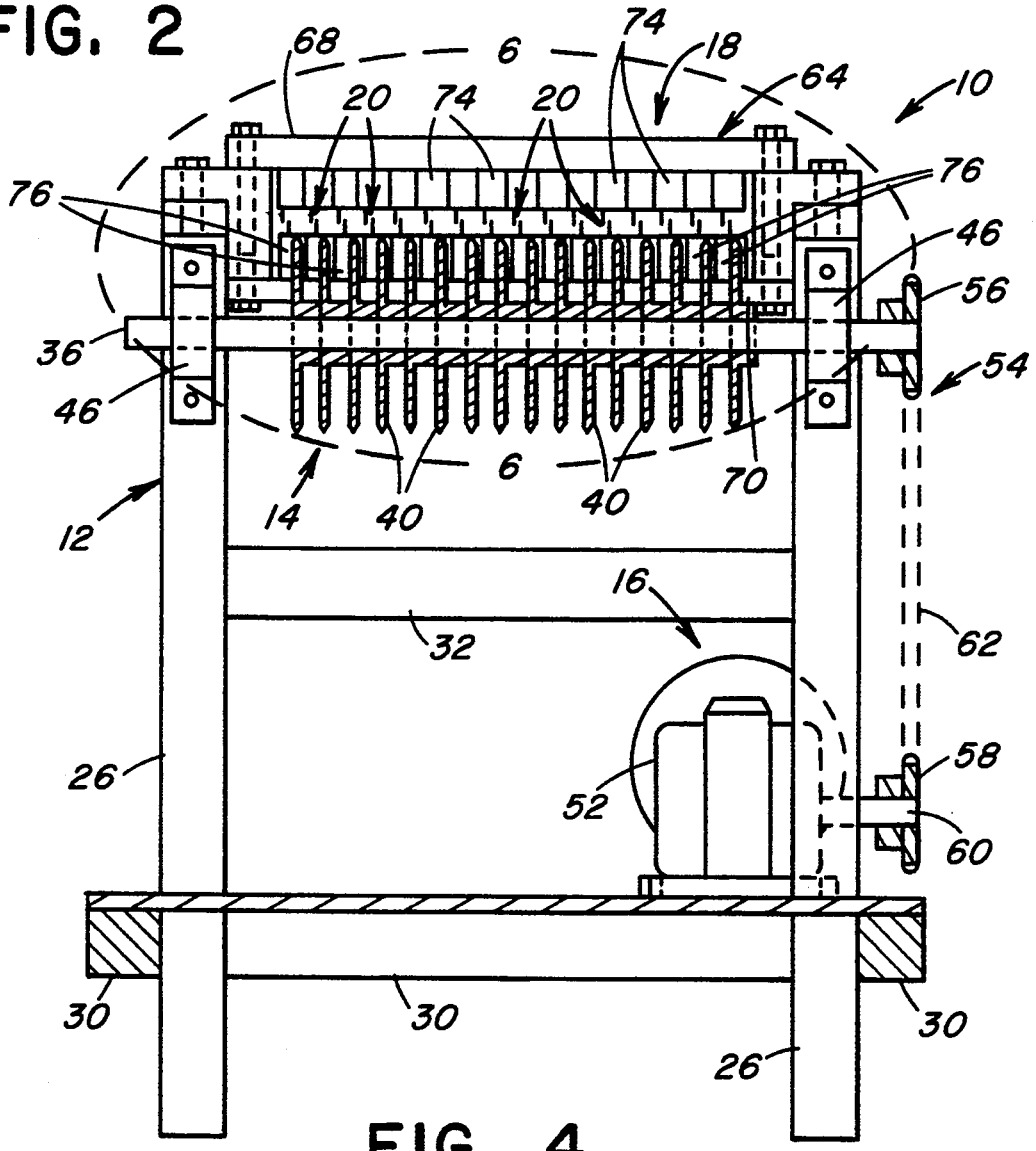
FIG. 4 is an end elevational, partly sectional, view of the kerfing apparatus as seen along fine 4—4 of FIG. 3.
Figure 3:
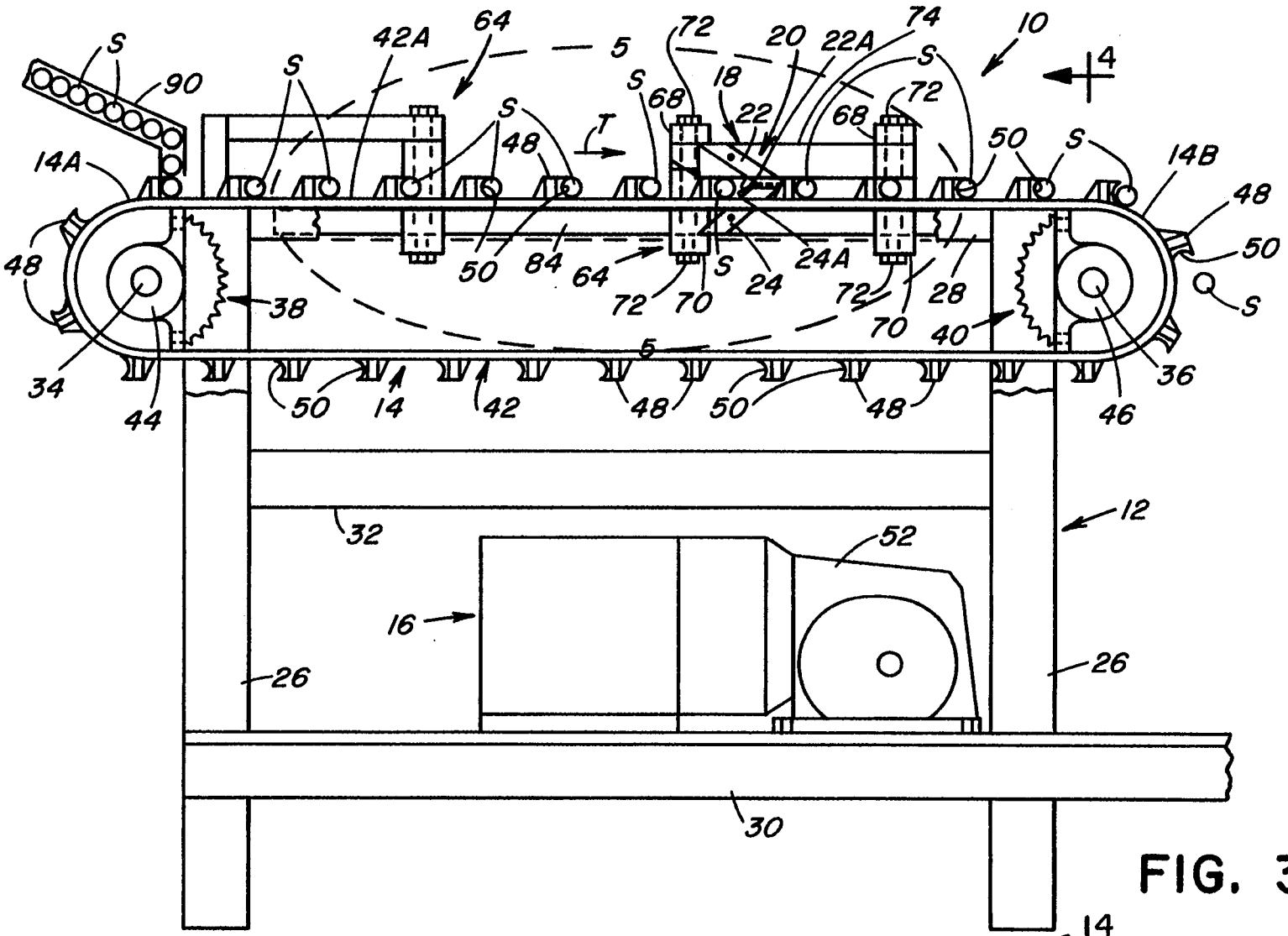
FIG. 3 is a side elevational view of the propellant stick kerfing apparatus of the present invention.
Figure 7:
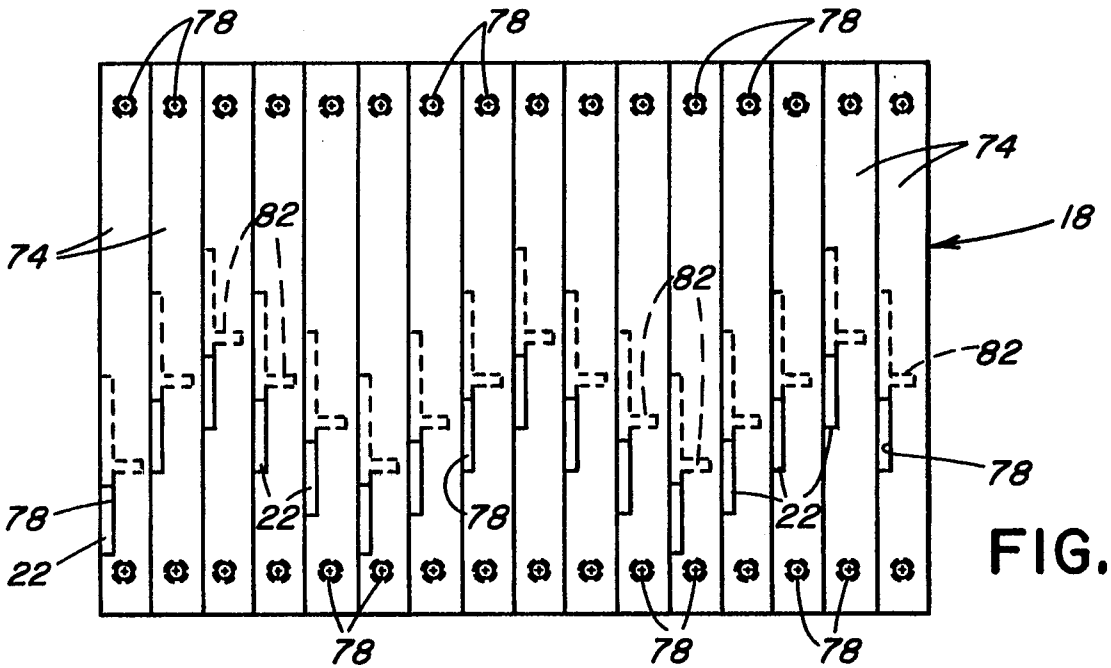
FIG. 7 is a top plan view of a plurality of pairs of kerfing blades of the kerfing apparatus as seen along line 7—7 of FIG. 6.
Figure 5:
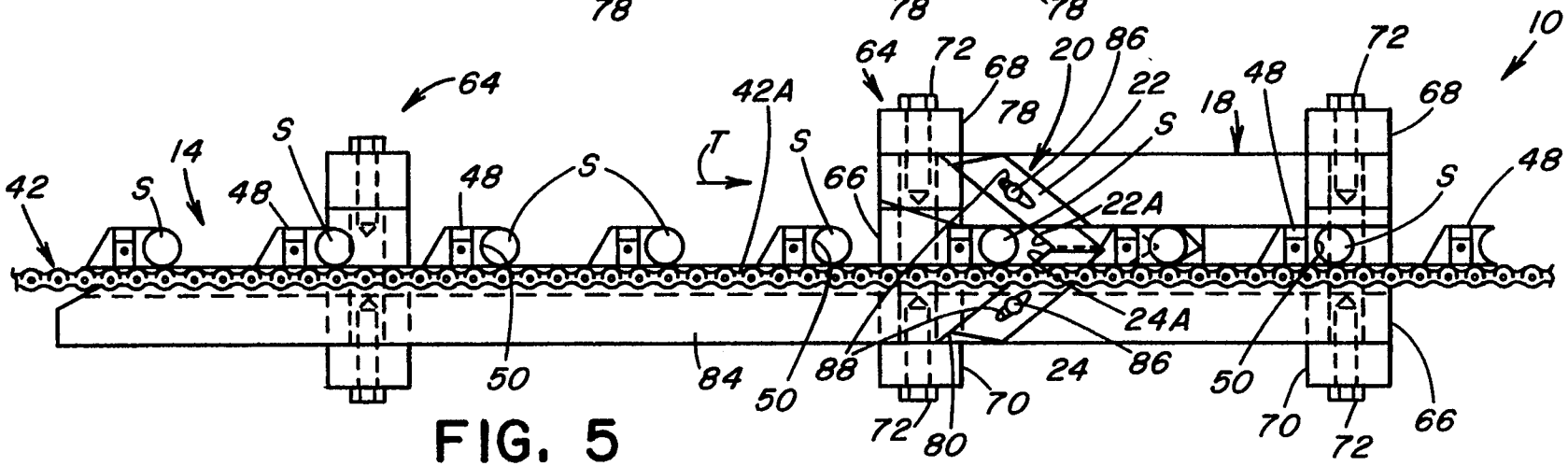
FIG. 5 is an enlarged detailed view of the portion of the kerfing apparatus contained in oval 5—5 of FIG. 3.
Figure 6:
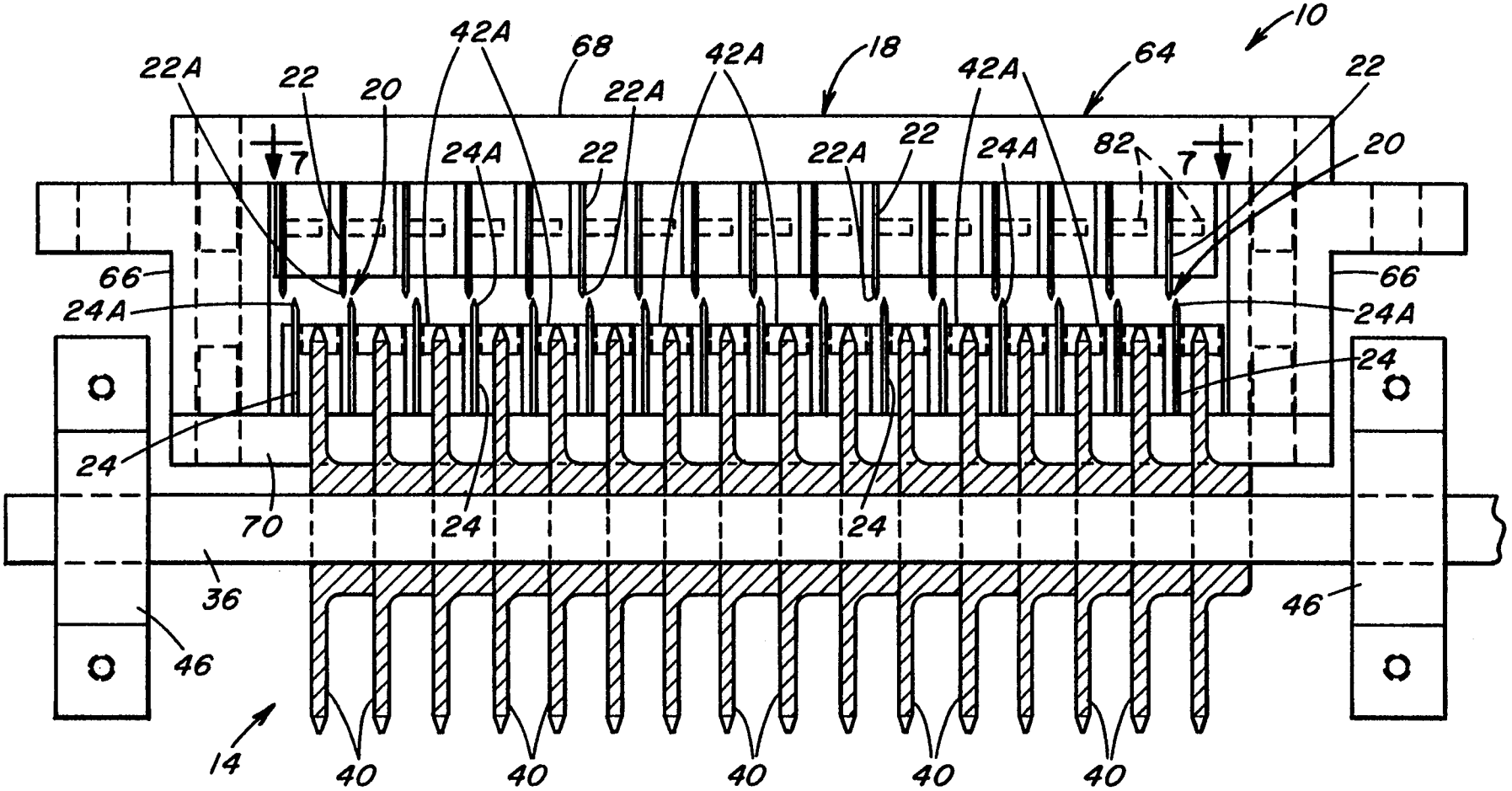
FIG. 6 is an enlarged detailed view of the portion of the kerfing apparatus contained in oval 6—6 of FIG. 4.

Referring to FIGS. 3 and 4, the kerfing apparatus 10 of the present invention basically includes a support frame 12, a conveyor 14, a drive arrangement 16, and a cutter assembly 18. The conveyor 14 is mounted on the support frame 12 for advancing a succession of spaced propellant sticks S along a path of travel with the sticks S extending in transverse relation to their direction of travel T. The drive arrangement 16 is mounted on the support frame 12 and coupled to the conveyor 14 for driving the conveyor 14 to advance the succession of propellant sticks S in the direction of travel T from an infeed end 14A to a discharge end 14B of the conveyor 14. The cutter assembly 18 is mounted on the support frame 12 extending across the conveyor 14. The cutter assembly 18 includes a plurality of pairs 20 of upper and lower blades 22, 24 having cutting edges 22A, 24A for making the axially spaced pairs of transaxial kerfs C in the propellant sticks S from opposite upper and lower sides thereof as the succession of spaced sticks S are advanced in the direction of travel T between the blade cutting edges 22A, 24A by the conveyor 14.

Referring to FIGS. 3–6, by way of example, the support frame 12 of the kerfing apparatus 10 can be provided in the form of a table or bench. The bench 12 is composed of a plurality of spaced upright corner legs 26 and a plurality of spaced upper, lower and middle longitudinal and transverse beams 28, 30, 32 extending between and rigidly interconnecting the upright corner legs 26.

The conveyor 14 of the kerfing apparatus 10 preferably includes a pair of elongated first and second shafts 34, 36, first and second pluralities of rotary members in the form of sprockets 38, 40, and a plurality of endless flexible drive members in the form of drive chains 42. At their respective opposite ends, the shafts 34, 36 are rotatably mounted by respective pairs of brackets 44, 46 being attached to upper locations on the corner legs 26 at the opposite ends of the support frame 12. The shafts 34, 36 are disposed by the brackets 44, 46 outwardly from the respective opposite ends of the support frame 12 to extend between opposite sides thereof in generally parallel spaced apart relation to one another.

The first and second pluralities of sprockets 38, 40 are mounted in side-by-side relation to one another on the respective shafts 34, 36 for rotation therewith. The drive chains 42 extend in side-by-side spaced relation between the opposite shafts 34, 36 and are entrained over the first and second pluralities of sprockets 38, 40 so as to define a plurality of laterally spaced apart side-by-side upper propellant stick-transporting spans 42A of the conveyor 14.

The conveyor 14 further includes a plurality of holder elements 48 mounted to and projecting outwardly from each of the drive chains 42 in longitudinally spaced relation therealong. The holder elements 48 on each drive chain 42 are aligned with holder elements 48 on adjacent drive chains 42, thereby forming rows extending transversely to the direction of travel T of the upper transport spans 42A of the drive chains 42. The holder elements 48 of each transverse row define respective forwardly facing pockets 50 configured to seat one propellant stick S and together with the upper spans 42A of the drive chains 42 to advance the stick S by pulling it along the path of travel upon operation of the conveyor 14.

The drive arrangement 16 of the kerfing apparatus 10 is operable to movably drive the endless drive chains 42 of the conveyor 14 along endless paths and thereby to move the upper spans 42A of the drive chains 42 so as to advance the succession of propellant sticks S along the path of travel. More particularly, the drive arrangement 16 includes a rotary drive motion source, such as an electric motor 52 mounted upon the lower longitudinal and transverse beams 30 of the support frame 12, and a drive train 54 drivingly coupling the motor 52 with an end of the one elongated shaft 36. The drive train 54 includes a pair of upper and lower sprockets 56, 58 respectively attached on the end of the shaft 36 of the conveyor 14 and the end of an output shaft 60 of the motor 52, and an endless flexible motion transmitting member in the form of an endless chain 62 extending between and entrained over the sprockets 56, 58. Upon operation of the motor 52, the rotary drive motion of its output shaft 60 is transmitted by the chain 62 to the one shaft 36 of the conveyor 14 to drive the conveyor drive chains 42 about their endless paths such that their upper spans 42A move in the direction T.

Referring to FIGS. 3–7, the cutter assembly 18 of the kerfing apparatus 10 includes a support assembly 64 mounted to upper longitudinal beams 28 of the support frame 12 and extending across the conveyor 14 between the opposite sides of the support frame 12. The support assembly 64 includes vertical columns 66 attached to and spaced longitudinally along the upper longitudinal beams 28 of the support frame 12. The support assembly 64 also has pairs of upper and lower horizontal support members 68, 70 disposed respectively above and below the upper spans 42A of the endless drive chains 42 and extending between the opposite sides of the support frame 12. The pairs of upper and lower support members 68, 70 are longitudinally spaced from one another and rigidly attached at their opposite ends to upper and lower ends of the vertical columns 66, such as by fasteners 72.

The support assembly 64 further includes upper and lower ganged support bars 74, 76 disposed in closely packed side-by-side relation with one another between the upper and lower support members 68, 70. The upper and lower ganged support bars 74, 76 are arranged in pairs being attached at their opposite ends by screws 78 to the upper and lower support members 68, 70. The upper and lower support bars 74, 76 of each pair have formed on their same one vertical sides oppositely inclined blade guide recesses 78, 80 and a threaded hole 82 extending perpendicular to and intersecting with the recesses 78, 80. Also, the support assembly 64 includes a plurality of side-by-side guide members 84 provided as extensions of the lower support members 70. The guide members 84 extend longitudinally in alignment with the upper spans 42A of the drive chains 42 so as to underlie and support the same.

The upper and lower cutting blades 22, 24 are mounted within the respective oppositely inclined recesses 78, 80 of the blade support bars 74, 76 by fasteners 86 which thread into the holes 82. Thus, the upper and lower blades 22, 24 are arranged in pairs 20 which, as with the pairs of blade support bars 74, 76, are disposed across the path of travel of the propellant sticks S. The pairs 20 of upper and lower blades 22, 24 define pairs of upper and lower cutting edges 22A, 24A. The upper and lower blades 22, 24 are adjusted so that their cutting edges 22A, 24A are laterally offset and vertically overlapped with respect to one another. Further, each pair of upper and lower cutting edges 22A, 24A is laterally spaced from adjacent pairs thereof in a direction transverse to the direction of travel T of the propellant sticks. Also, the blades 22, 24 have slots 88 receiving the fasteners 86 which permit adjustable movement of the upper and lower cutting blades 22, 24 along the recesses 78, 80 in the direction of their respective inclinations and then securing of the blades 22, 24 at desired settings to thereby change the amount of vertical overlap with respect to one another.

The pairs of cutting edges 22A, 24A of the blades 22, 24 are stationary and oppositely inclined, converging forwardly toward one another and intersecting the path of travel of the propellant sticks S. The backwardly canted or inclined cutting edges 22A, 24A will thus provide a slicing action to make pairs of transaxial kerfs C in the propellant sticks S from the opposite upper and lower sides thereof as the succession of spaced sticks S are advanced along the path of travel between the cutting edges. The staggering of the blades 22, 24 in the direction of travel T means that only a fraction of the total number of blades are engaged in the propellant stick S at any instance of time.

The kerfing apparatus 10 operates in accordance with the kerfing method of the present invention. A succession of unkerfed propellant sticks S is supplied to the kerfing apparatus 10 from an inclined delivery ramp 90 positioned adjacent to the one end of the support frame 12 corresponding to the infeed end of the conveyor 14. Under the influence of gravity, the propellant sticks S roll down the inclined delivery ramp and are dispensed one at a time onto the infeed end 14A of the conveyor 14 where they are engaged by successive rows of the holder elements on the drive chains 42 of the conveyor 14. The conveyor 14 advances the succession of spaced propellant sticks S in the direction of travel T while seated in the pockets 50 of the holders 48 on the drive chains 42 and extending in transverse relation to the direction of travel T. Such conveyance of the propellant sticks S advances them between the upper and lower stationary blades 22, 24 of the laterally spaced pairs 20 thereof that are disposed across the path of travel of the succession of propellant sticks. The propellant sticks S are successively advanced into engagement with the oppositely inclined cutting edges 22A, 24A of the staggered pairs of inclined blades 22, 24 which then make or cut the pairs of transaxial kerfs C in the propellant sticks S from opposite upper and lower sides thereof. As the kerfed propellant sticks S reach the discharge end 14B of the conveyor 14, they are removed therefrom in a suitable manner (not shown).

There are several advantages provided by the kerfing apparatus 10 of the present invention over the conventional kerfing technique. First, since the propellant sticks are continuously moved through the slicing or cutting blades, production rates can be increased while maintaining a similar velocity of the propellant sticks with respect to the blades. Second, the same amount of time is required for kerfing any stick of propellant regardless of length. Third, the staggering of the blade pairs minimizes the effects of propellant compression during slicing. The reduced propellant compression decreases the forces created normal to the surface of the blades and, in turn, generates lower frictional forces to resist cutting. Fourth, the reduced compression coupled with the angled blades enables the kerfing operation to be completed while subjecting the propellant to a much lower magnitude of force. The lower force involved in this kerfing method reduces the risk of fracturing or otherwise damaging the internal structure of the propellant stick. In summation, the propellant kerfing apparatus and method of the present invention provides a more reliable high rate production operation than has been available heretofore.

Also, the kerfing apparatus 10 of the present invention can be employed to finish propellant sticks having outside diameters falling within a range. An example is a machine designed to finish propellant sticks having an outside diameter within a range of 0.440 to 0.700 inch. A maximum stick diameter may be designed into the machine and any stick of lesser diameter may be kerfed on the same machine. Kerf spacing would remain constant, but kerf offset and overlap could be adjusted as would be practical for smaller propellant stick diameters.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A propellant stick kerfing apparatus, comprising:

(a) a support frame;

(b) means mounted on the frame for conveying a succession of spaced propellant sticks along a path of travel with the propellant sticks extending in transverse relation to the direction of travel;

(c) means mounted on the support frame and coupled to the conveying means for driving the conveying means to advance the succession of propellant sticks along the path of travel; and (d) means mounted on the support frame across the path of travel of the propellant sticks and defining stationary cutting edges for making transaxial kerfs in the propellant sticks from opposite upper and lower sides thereof as the succession of spaced sticks ace advanced along the path of travel between the cutting edges.

2. The kerfing apparatus of claim 1 wherein said means defining said cutting edges includes pluralities of upper and lower blades having inclined cutting edges which converge forwardly toward one another and intersect the path of travel of the succession of propellant sticks for making the transaxial kerfs in the propellant sticks as the succession of sticks are advanced along the path of travel between said cutting edges.

3. The kerfing apparatus of claim 1 wherein said means defining said cutting edges includes a plurality of pairs of upper and lower blades, each pair being spaced from adjacent pairs in a direction transverse to the direction of travel, said upper and lower blades of each pair being laterally offset from one another and vertically overlapped with one another.

4. The kerfing apparatus of claim 1 wherein said means defining said cutting edges includes a plurality of pairs of upper and lower blades, each pair being spaced from adjacent pairs in a direction transverse to the direction of travel and staggered relative to adjacent pairs in the direction of travel.

5. The kerfing apparatus of claim 1 wherein said conveying means includes:

first and second elongated shafts rotatably mounted in generally parallel spaced apart relation to one another on said support frame:

first and second pluralities of rotatable members mounted on said shafts for rotation therewith; and a plurality of side-by-side spaced endless flexible members extending between said first and second shafts and entrained over said first and second pluralities of rotatable members so as to provide a plurality of upper transport spans disposed in laterally spaced apart side-by-side relation.

6. The kerfing apparatus of claim 5, wherein:

said rotatable members are sprockets; and said endless flexible members are chains.

7. The kerfing apparatus of claim 5 wherein said driving means includes:

a rotary drive motion source mounted on said frame; and an endless flexible motion transmitting member extending between and coupled to said drive motion source and one of said first and second shafts such that rotary drive motion is transmitted by said motion transmitting member to said one shaft to drive said conveying means upon operation of said drive motion source.

8. The kerfing apparatus of claim 5 wherein said conveying means includes a plurality of holder elements mounted to each of said endless flexible drive members in longitudinally spaced relation therealong, said holder elements on each drive member being aligned in transverse rows with said holder elements on adjacent ones of said side-by-side drive members, said holder elements of each row thereof being configured to seat one propellant stick and together with said drive members to advance the stick along the path of travel upon operation of said conveying means.

9. The kerfing apparatus of claim 5 wherein said supporting means includes:

upper and lower support members respectively mounted above and below said upper spans of said flexible drive members; and upper and lower pluralities of blades arranged in pairs of upper and lower blades and mounted respectively to said upper and lower support assemblies, said pairs of upper and lower blades defining said cutting edges in oppositely inclined pairs thereof, each pair of upper and lower blades being spaced from adjacent pairs of blades in a direction transverse to the direction of travel, said upper and lower blades of each pair being laterally offset and vertically overlapped with respect to one another.

10. The kerfing apparatus of claim 9 wherein said upper and lower cutting blades are movably adjustable in the direction of their respective oppositely inclined cutting edges to change the amount of vertical overlapped with respect to one another.

11. The kerfing apparatus of claim 9 wherein said oppositely inclined cutting edges of said pairs of blades face one another, converge forwardly toward one another, and intersect the path of travel of the succession of propellant sticks for engaging the sticks and making pairs of transaxial kerfs in the sticks as the succession of sticks are advanced along the path of travel between said upper and lower blades.

12. The kerfing apparatus of claim 10 wherein each said pair of upper and lower blades is spaced from adjacent pairs of blades in a direction transverse to the direction of travel and staggered relative to adjacent pairs of blades in the direction of travel.

13. A propellant stick kerfing apparatus, comprising:

(a) a support frame;

(b) means mounted on the frame for conveying a succession of spaced propellant sticks along a path travel with the sticks extending in transverse relation to the direction of travel, said conveying means including a plurality of side-by-side spaced endless flexible members being mounted on said support frame for movement about endless paths, said endless flexible members having a plurality of upper transport spans disposed in lateral spaced apart side-by-side relation;

(c) a plurality of side-by-side guide members mounted on said frame and underlying and supporting said side-by-side upper spans of said endless flexible members;

(d) a drive arrangment mounted on said frame and coupled to said endless flexible members, said drive arrangement being operable to drive said endless members along their endless paths and thereby to move said upper spans of said endless members so as to advance the succession of propellant sticks along the path of travel;

(e) a plurality of holder elements mounted to each of said endless flexible members in longitudinally spaced relation therealong, said holder elements on each endless flexible member being aligned in transverse rows with said holder elements on adjacent ones of said endless flexible members, said holder elements of each row thereof being configured to seat one propellant stick and together with said upper spans of said endless flexible members to advance the stick along the path of travel upon operation of said drive arrangement:

(f) upper and lower support assemblies mounted on said support frame respectively above and below said upper spans of said endless flexible members; and (g) upper and lower pluralities of cutting blades mounted to said upper and lower support assemblies and arranged in pairs of upper and lower blades disposed across the path of travel of the propellant sticks, said upper and lower blades of each pair being Laterally offset and vertically overlapped with respect to one another, each said pair of upper and lower blades being laterally spaced from adjacent pairs of upper and lower blades in a direction transverse to the direction of travel of said propellant sticks, said upper and lower blades of each pair defining oppositely inclined stationary cutting edges converging forwardly toward one another and intersecting the path of travel of the propellant sticks along said guide member so as to make pairs of transaxial kerfs in the propellant sticks from opposite upper and lower sides thereof as the succession of spaced sticks are advanced along the path of travel between the cutting edges.

14. The kerfing apparatus of claim 13 wherein said conveying means further includes:

first and second elongated shafts rotatably mounted in generally parallel spaced apart relation to one another on said support frame; and first and second pluralities of sprockets mounted on said shafts for rotation therewith and mounting said plurality of side-by-side spaced endless flexible members.

15. The kerfing apparatus of claim 14 wherein said drive members are endless drive chains extending between said first and second shafts and entrained over said first and second pluralities of sprockets so as to define said plurality of laterally spaced apart side-by-side upper transport spans.

16. The kerfing apparatus of claim 13 wherein said upper and lower cutting blades are movably adjustable along the direction of their respective oppositely inclined cutting edges to change the amount of vertical overlapped with respect to one another.

17. A propellant stick kerfing method, comprising the steps of:

(a) conveying a succession of spaced propellant sticks along a path of travel with the propellant sticks extending in transverse relation to the direction travel;

(b) stationarily disposing a plurality of pairs of upper and lower blades across the path of travel of the succession of spaced propellant sticks with each pair of upper and lower blades being spaced from adjacent pairs of blades in a direction transverse to the direction of travel of the succession of propellant sticks; and (c) engaging oppositely inclined cutting edges of the pairs of blades with the succession of propellant sticks and making transaxial kerfs in the propellant sticks from opposite upper and lower sides thereof as the succession of spaced sticks are advanced along the path of travel between the cutting edges of the pairs of blades.

18. The kerfing method of claim 17 wherein said disposing of the pairs of upper and lower blades includes laterally offsetting the upper and lower blades of each pair from one another.

19. The kerfing method of claim 17 wherein said disposing of the pairs of upper and lower blades includes vertically overlapping the upper and lower blades with one another.

20. The kerfing method of claim 17 wherein said disposing of the pairs of upper and lower blades includes staggering the pairs of blades in the direction of travel relative to adjacent pairs of blades.

* * * * *

UNITED STATES PATENT AND TRADEMARK OFFICE

CERTIFICATE OF CORRECTION

PATENT NO. : 5,349,892

DATED : September 27, 1994

INVENTOR(S) : Taylor et al

It is certified that error appears in the above-indentified patent and that said Letters Patent is hereby corrected as shown below:

Col. 7, line 63, delete "ace" and insert -- are --;

Col. 9, line 25, insert after the word "path" the word -- of --;

Col. 9, line 31, delete "lateral" and insert -- laterally --;

Col. 9, line 64, delete "Laterally" and insert -- laterally --;

Signed and Sealed this

Fourteenth Day of November, 1995

*Attest:*

*Attesting Officer*

Bruce Lehman

BRUCE LEHMAN

*Commissioner of Patents and Trademarks*